United States Patent [19]

Cook

[11] Patent Number: 4,714,251

[45] Date of Patent: Dec. 22, 1987

[54] BALL BAT

[75] Inventor: David C. Cook, Valparaiso, Ind.

[73] Assignee: Thomas O. Cook, Orlando Park, Ill. ; a part interest

[21] Appl. No.: 816,320

[22] Filed: Jan. 6, 1986

[51] Int. Cl.[4] ..... A63B 59/06

[52] U.S. Cl. ..... 273/72 R

[58] Field of Search ..... 273/72 A, 72 R, 67 R, 273/67 A, 67 C, 67 D, 67 DA, 67 DB, 67 DC, 26 B, 82 R, 73 F, 80 B

[56] References Cited

U.S. PATENT DOCUMENTS

| | | | |
|---|---|---|---|
| 533,272 | 1/1895 | Burrows | 273/72 R |
| 795,815 | 8/1905 | Burrows | 273/72 R |
| 1,706,680 | 3/1929 | Smith | 273/72 R |
| 2,793,859 | 5/1957 | Darling et al. | 273/72 R |
| 4,572,508 | 2/1986 | You | 273/72 R |

FOREIGN PATENT DOCUMENTS

| | | | |
|---|---|---|---|
| 455116 | 3/1949 | Canada | 273/67 A |

*Primary Examiner*—Richard C. Pinkham
*Assistant Examiner*—Matthew L. Schneider
*Attorney, Agent, or Firm*—Thomas J. Dodd

[57] ABSTRACT

A ball bat which includes three portions formed of different types of wood and laminated together. The bat portions are formed of light wood, heavy wood and soft wood, respectively, from the handle to the barrel end of the bat.

5 Claims, 3 Drawing Figures

BALL BAT

SUMMARY OF THE INVENTION

This invention relates to a bat, and will have special application to a baseball bat.

Throughout the brief history of the sport of baseball, various individuals have attempted to improve the performance and durability of the baseball bat. It has long been recognized that heavy wood, such as hickory, tends to lengthen the distance of a batted ball, and increases the speed at which the ball leaves the bat, all to the advantage of the batter. Unfortunately, a bat constructed only of such heavy wood cannot be wielded effectively due to extreme bat weight. Previous bats attempted to resolve this problem by forming the barrel end of the bat from heavy wood, then laminating the barrel to a handle of lighter wood such as ash. However, the intense vibrational forces of an off-center hit tend to break such bats regularly, and at today's prices, replacement of many bats may become quite expensive.

The bat of this invention is formed of three distinct portions laminated to form the bat. The handle section of the bat is formed of light wood such as white ash. The center or intermediate bat portion is formed of heavy wood such as hickory. The barrel end of the bat is formed of a soft wood such as soft maple, or other softwoods, and serves to reduce the shock of the bat handle while reducing slide-off spin of a ball which is hit on the barrel end.

Accordingly, it is an object of this invention to provide for an improved laminated baseball bat.

Another object of this invention is to provide for a laminated baseball bat which is more durable than previous bats.

Another object of this invention is to provide for a laminated baseball bat which reduces slide-off spin of a batted ball.

Other objects of this invention will become apparent upon a reading of the following description.

BRIEF DESCRIPTION OF THE DRAWINGS

A preferred embodiment of the invention has been chosen for purposes of illustration werein.

DESCRIPTION OF THE PREFERRED EMBODIMENT

Figures 1, 3:
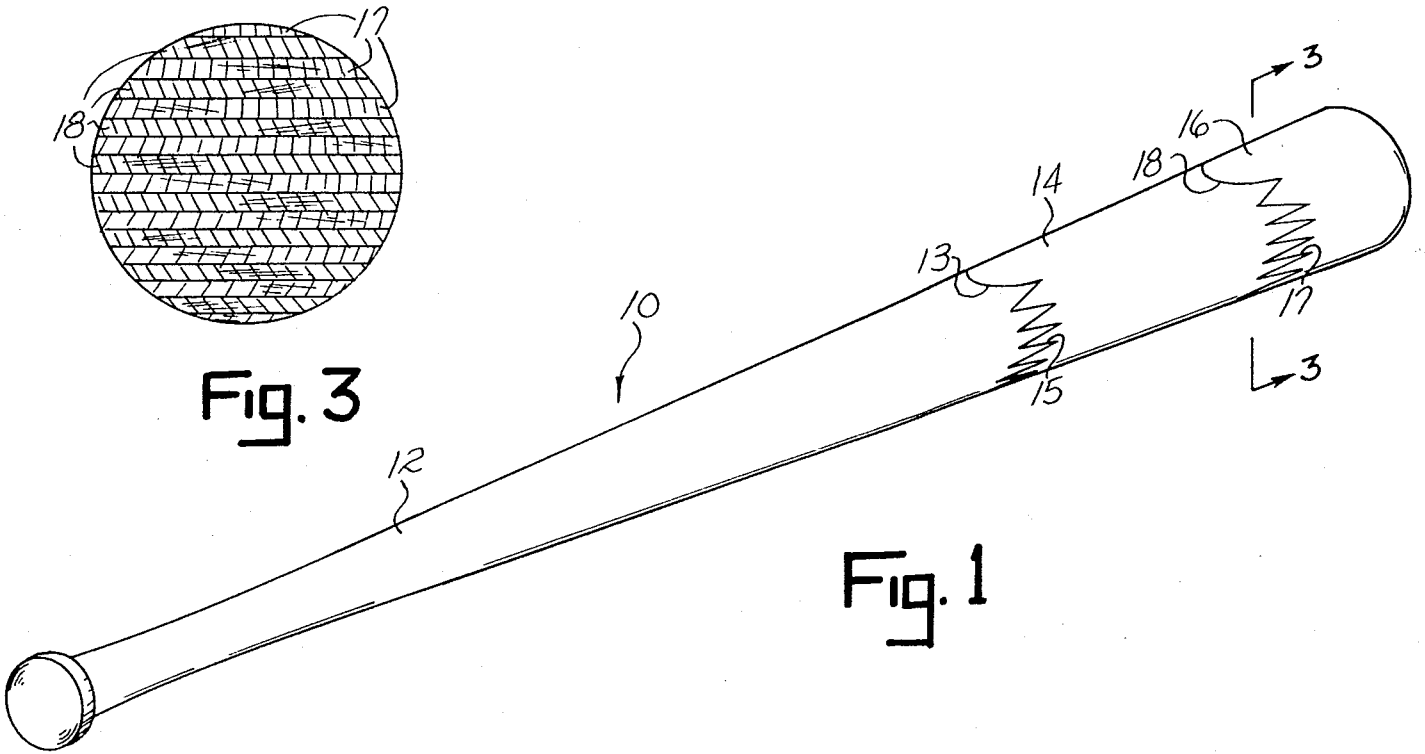
FIG. 1 is a perspective view of the ball bat.
FIG. 3 is a cross sectional view taken along line 3—3 of FIG. 1.
Figure 2:
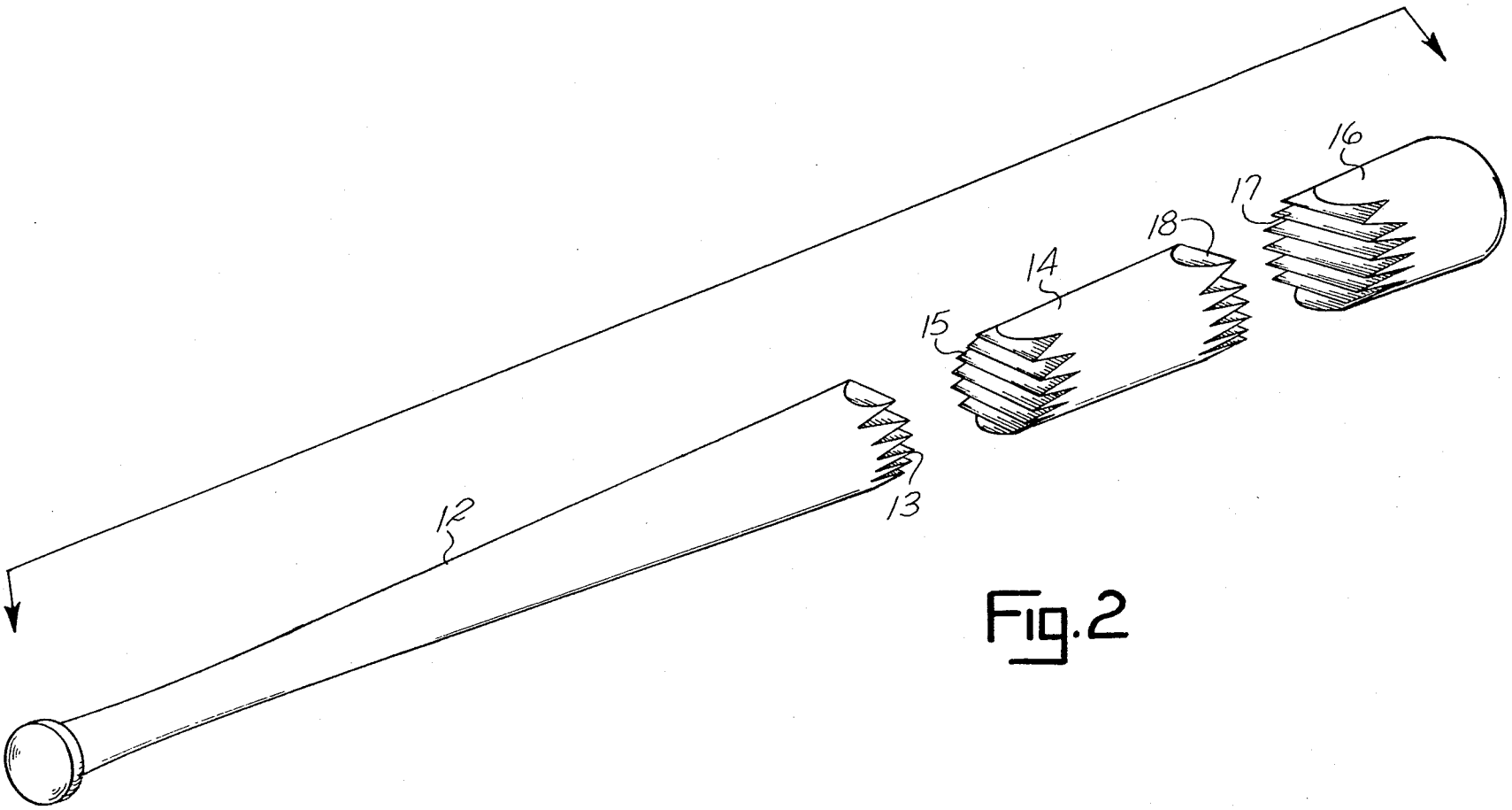
FIG. 2 is an exploded view of the ball bat.

The preferred embodiment herein described is not intended to be exhaustive or to limit the invention to the precise form disclosed. It is chosen and described to explain the principles of the invention and its application and practical use to enable others skilled in the art to utilize the invention.

The ball bat 10 shown in the drawings includes three distinct portions, namely, a handle portion 12, an intermediate or ball-striking portion 14, and a barrel end portion 16. For purposes of this discussion, the bat 10 will be of average length and weight for a Major League baseball player (approximately 34 inches in length and weighing 34 ounces), although the bat length and weight may be adjusted in any conventional manner.

A complete bat 10 is first formed in individual parts. Handle portion 12 is formed of a light wood, preferably white ash and includes formed finger joints 13. In a 34-inch bat, the handle portion 12 will be approximately 23 inches in length. Ball-striking portion 14 is formed of a heavy wood, preferably hickory, and includes formed finger joints 15, 18 at each end thereof. Striking portion 14 is approximately 7 inches in length. Bat barrel end portion 16 is formed of a soft wood, such as soft maple, and includes finger joints 17. Other soft woods may be used to form barrel end 16, such as redwood, western birch, beech, or white fir. Barrel end 16 is preferably 4 inches long. Finger joints 13, 15, 17, and 18 may be shaped in any conventional manner.

After the individual segments of bat 10 are formed the bat is assembled by applying a conventional bat laminate such as casein cross linking resin emulsion, to finger joints 13, 15, 17 and 18. Joints 13 and 15 are then mated and joints 17 and 18 mated. The laminate is then allowed to cure, after which the bat may be varnished or painted prior to use.

It is understood that the above description does not limit the invention to those details, but may be modified within the scope of the appended claims.

I claim:

1. A ball bat comprising an elongated body which includes a handle end portion and a barrel end portion, said elongated body having a progressively decreasing cross sectional area from the barrel end to the handle end, said handle end portion formed of a light hard wood, said barrel end portion formed of a softer wood than the handle end portion, said body further including a portion intermediate said handle end portion and said barrel end portion, said intermediate portion formed of a heavy wood relative to said handle end light wood and barrel end soft wood, said handle end portion joined to said intermediate portion at one end thereof, said barrel end portion joined to an opposite end of said intermediate portion to form said bat body.

2. The bat of claim 1 wherein said light wood is white ash and said heavy wood is hickory.

3. The bat of claim 2 wherein said soft wood is beech, white fir, western birch, redwood, or soft maple.

4. The bat of claim 1 wherein said bat handle portion includes first longitudinal finger joints, said bat intermediate portion including second longitudinal finger joints at one end thereof complemental with said first longitudinal finger joints, said first and second finger joints constituting means for mating said bat handle portion with said bat intermediate portion.

5. The bat of claim 4 wherein said bat intermediate portion includes third longitudinal finger joints at an end opposite said one end, said bat barrel end portion including fourth longitudinal finger joints complemental with said third longitudinal finger joints, said third and fourth finger joints constituting means for mating said bat intermediate portion with said bat end portion.

* * * * *